United States Patent [19]

Nongbri

[11] 4,217,206

[45] Aug. 12, 1980

[54] EXTENDING LIFE OF DEMETALLIZATION CATALYST

[75] Inventor: Govanon Nongbri, Newton, Pa.

[73] Assignee: Hydrocarbon Research, Inc., Lawrenceville, N.J.

[21] Appl. No.: 817,275

[22] Filed: Jul. 20, 1977

[51] Int. Cl.[2] ..... C10G 25/00

[52] U.S. Cl. ..... 208/251 H

[58] Field of Search ..... 208/251 H

[56] References Cited

U.S. PATENT DOCUMENTS

| | | | |
|---|---|---|---|
| 3,870,623 | 3/1975 | Johnson et al. | 208/251 H |
| 3,901,792 | 8/1975 | Wolk et al. | 208/251 H |
| 3,947,347 | 3/1976 | Mitchell | 208/251 H |
| 4,045,331 | 8/1977 | Ward | 208/251 H |

*Primary Examiner*—Delbert E. Gantz
*Assistant Examiner*—Wayne A. Langel
*Attorney, Agent, or Firm*—Michael A. Jacobs

[57] ABSTRACT

In the catalytic demetallization of Venezuelan crude oil feedstocks, the rate of catalyst deactivation is reduced by controlling the level of demetallization at start-up. Operating conditions of pressure, temperature and space velocity are controlled to maintain the initial level of demetallization below 75 percent.

10 Claims, 3 Drawing Figures

FEED PROPERTIES

| FEED | BACHEQUERO EXPORT | GACH SARAN | LLOYDMINSTER |
|---|---|---|---|
| °API | 7.6 | 6.9 | 6.4 |
| % S | 3.1 | 3.72 | 5.40 |
| PPMV | 547 | 291 | 169 |
| PPM NL | 74 | 110 | 95 |

EXTENDING LIFE OF DEMETALLIZATION CATALYST

BACKGROUND OF THE INVENTION

1. Field of the Invention

This invention pertains to the demetallization of petroleum crude oils. More particularly, the invention relates to an improved method of demetallizing Venezuelan petroleum crude oils in the presence of demetallization catalyst or contact solids and hydrogen wherein the demetallization catalyst life is extended thereby substantially reducing catalyst replacement costs.

2. Description of the Prior Art

Federal environmental pollution standards are becoming increasingly stringent with respect to the permissible amount of sulfur emissions. Due to the increasing demands for energy coupled with the need for low sulfur content fuel oil, energy needs are being met through the upgrading of high sulfur petroleum residuum. To this end, many methods are known for desulfurizing these high sulfur containing residuums. However, one of the greatest difficulties in desulfurizing such feedstocks is due to metal containing contaminants, for example, vanadium and nickel, which rapidly poison desulfurization catalysts by blocking active sites, thereby rendering sulfur removal possesses economically unattractive. In order to obviate such problems many prior art methods are disclosed for the removal of vanadium and nickel from petroleum residuums in the presence of demetallization catalysts or contact solids and hydrogen.

Examples of such prior art methods can be found in U.S. Pat. Nos. 2,764,525 and 2,730,487 which disclose treating petroleum fractions with iron oxide on alumina and Titania on alumina respectively to remove metals. U.S. Pat. No. 2,776,183 discloses a demetallization process utilizing Fuller's Earth, while U.S. Pat. No. 2,769,758 discloses bauxite as the demetallization material.

Another prior art method is disclosed in U.S. Pat. No. 3,964,995 which is directed to a hydrodesulfurization process in two stages wherein the first stage is a demetallization step and the demetallization catalyst is disclosed as being alumina promoted with $Fe_2O_3TiO_2$ and/or $S_iO_2$. U.S. Pat. No. 3,985,643 discloses demetallization utilizing spent hydrodesulfurization catalyst as the demetallizing agent. Many other contact solids with demetallization activity are known in the art.

While the prior art methods disclose generally many or various methods for demetallization of petroleum feedstocks to enhance and improve the efficiency of hydrodesulfurization steps, the prior art has failed to recognize the need for extending the life of the various demetallization catalysts.

Accordingly, it is an object of this invention to provide a method for the demetallization of Venezuelan petroleum residuums in which the catalyst life is optimized.

Other and additional objectives will become obvious to those skilled in the art following a consideration of the specification herein including the drawings and the claims.

SUMMARY OF THE INVENTION

Figure 1:
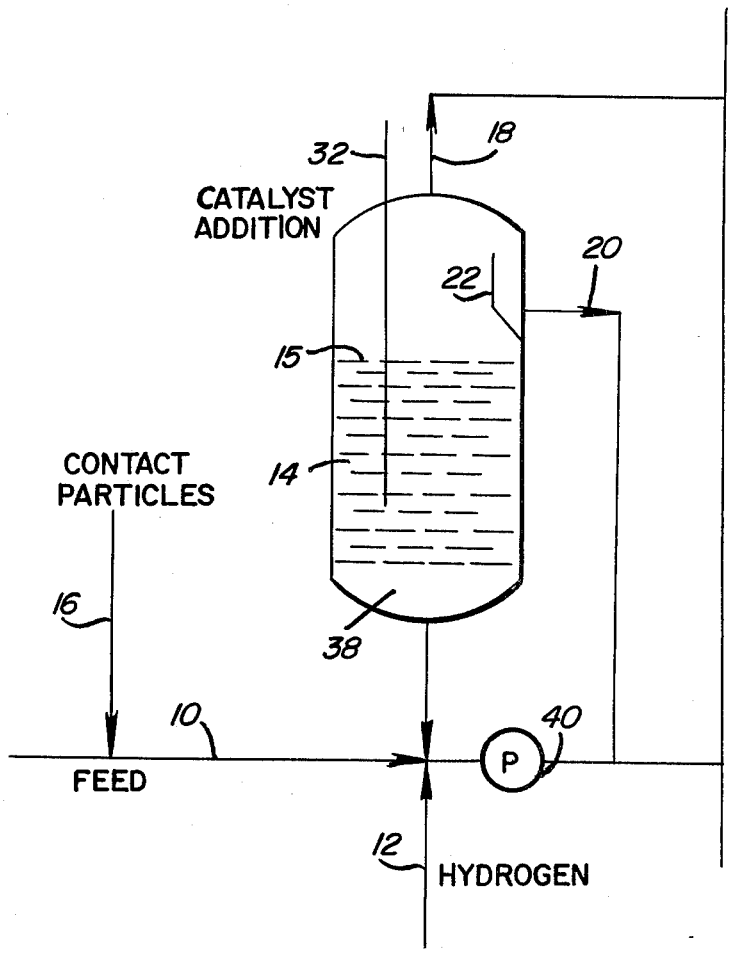
FIG. 1 is a schematic of a process for demetallization crude oil.

The principle metal contaminants of crude oil are nickel and vanadium which exist as relatively large organometallic compounds, such as porphyrins and asphaltenes which are generally most concentrated in residual oil fractions boiling above 650° F. Another major contaminant, sulfur, must be removed in order to produce an environmentally acceptable fuel. Accordingly, it is a generally accepted industry practice to remove metals prior to hydrodesulfurization since one of the principle disadvantages of catalytic hydrodesulfurization lies in the fact that such catalysts rapidly deactivate in the presence of metals.

Vanadium and nickel contaminants are removed from petroleum feedstocks by bringing into intimate contact, in the presence of hydrogen, a metals containing feedstock and a demetallization catalyst or contact solid. Conditions of temperature, pressure, and space velocities are chosen so that the metals are deposited on the demetallization material. Generally, suitable contact materials are known to those skilled in the art. Examples of demetallization contact materials are as follows: nickel oxide-molybdenum oxide, cobalt oxide, molybdenum oxide, nickel oxide-tungsten oxide, all on alumina, bauxite promoted with iron, cobalt, molybdenum, nickel, zinc, and manganese, promoted alumina and spent hydrofining catalysts.

Suitable operating conditions for demetallizing residuums are typically; 700°–850° F., 800–3000 psig, and space velocities between 0.2 and 1.5 $V_f/hr/V_r$.

It has been unexpectedly discovered that for high metals containing petroleum residuums for example, greater than 200 ppm Vanadium and nickel that deactivation of demetallization catalysts is not a function of metals contents of the feed but that the deactivation is a function of the initial level of feedstock demetallization. The initial demetallization level defined herein is the amount of metals removed under fixed reaction conditions, with fresh catalyst at startup. It has further been discovered that the foregoing relationship is most pronounced in the demetallization of Venezuelan residuums. Typical Venezuelan residuums are Bachaquero, Tia Juana, Lagunillas, Boscan, Orinoco, Jobo, etc. Accordingly, applicant has found that by operating the demetallization process under start-up conditions such that the initial level of vanadium removal from Venezuelan crude oil feedstocks does not exceed 75%, the catalyst life will be dramatically extended, thereby resulting in significant cost savings due to reduced catalyst replacement rates. The level of demetallization is controlled through adjustments in temperature, pressure or space velocity conditions. The demetallization process is preferably carried out in an ebullated bed process operated in accordance with the teachings of U.S. Pat. No. RE 25,770. However, the invention is not limited to ebullated bed applications and can be utilized in any stream in which catalysts and liquid are brought together in intimate contact, for example, a fixed bed typed reactor.

DETAILED DESCRIPTION OF THE INVENTION

The invention is further illustrated by reference to FIG. 1. In a preferred embodiment, a heavy hydrocarbon charge such as a metals containing Venezuelan residuum at 10, together with hydrogen at 12 is introduced into a reactor 14 of the type shown in U.S. Pat. No. 25,770, the disclosure of which is incorporated herein by reference. Such a reactor will be suitably charged with a demetallization contact material, such as promoted bauxite, the particles being of an average size between about 10 mesh and 270 mesh. A small makeup of fresh contact particles is combined with the feed at 16 or added separately at 32. Alternately, contact particles in the form of extrudates of ¼ inch to 1/32 inch diameter may be used or granules of 10 to 60 mesh may be used. Spent catalyst may be withdrawn through line 33.

While an ebullated bed reactor is preferred, it will be understood to those skilled in the art, that any device for bringing solids, liquids, and gases in intimate contact under elevated temperature and pressure conditions may be utilized. This can be a fluidized or fixed bed of catalyst or contact solids material.

In an ebullated bed system, the liquid and gas upflow through the bed of contact particles should be at sufficient velocity such that it will tend to expand the bed at least 10% based on the bed volume without fluid flow, and such that the particles are all in a random motion in the liquid.

Recycle of liquid effluent from above the contact particle interface 15 to below the distributor deck 38 is usually desirable to give proper temperature control and to establish a sufficient upflow velocity to assist in maintaining the particles in random motion, particularly in the case of particles in the form of 1/32 and ¼ inch diameter extrudates. This recycle may be accomplished either externally utilizing pump 40, or internally as described in No. Re 25,770.

Under the preferred conditions of temperature, pressure, throughput and product composition as hereinafter set forth, a vapor effluent is removed at 18 and a liquid effluent is removed at 20 from the upper portion 22 of the reaction zone. The liquid effluent may then be passed to a hydrotreating zone for further processing and upgrading.

Generally, demetallizing conditions are in the range of 700°–850° F., preferably between 750° F. and 840° F., hydrogen partial pressures between 800 and 3500 psig, preferably between 1000 and 2500, space velocities between 0.2 and 1.5 $V_f/hr/V_r$, preferably between 0.3 and 1.3, and catalyst replacement rates between 0.15 and 3.0 #/bbl feed preferably between 0.2 and 1.8. The initial level of demetallization is controlled through suitable adjustments in temperature, pressure, space velocity, or catalyst replacement rate. For example, assuming all demetallization conditions are constant, the raising or lowering of temperature or pressure will raise or lower the level of demetallization respectively, whereas an increase in the space velocity reduces the level of demetallization. Likewise, the higher the rate fresh catalyst is charged to the reactor, the greater the level of demetallization. It is within the skill of the ordinary practitioner in the art to recognize how to vary the various reaction conditions in order to give a specific level of demetallization. Furthermore, in a fixed bed system it is recognized that the level of demetallization will not be controlled by catalyst replacement rates.

The activity of the demetallization catalyst can be measured by the amount of Vanadium removed at certain operating conditions. To follow the change of activity at a given operating condition, one follows the change in the demetallization level with days on stream. For the demetallization operation, for example, over 1% Molybdenum on 20×50 mesh bauxite, this change in activity follows a straight line path when Vanadium removal (expressed as the ratio of Vanadium in Feed/Vanadium in Product) is plotted in a semi-log paper against the catalyst age expressed in Bbl/lb. The slope of the above line gives the magnitude of the rate of deactivation of the catalyst.

Figure 2:
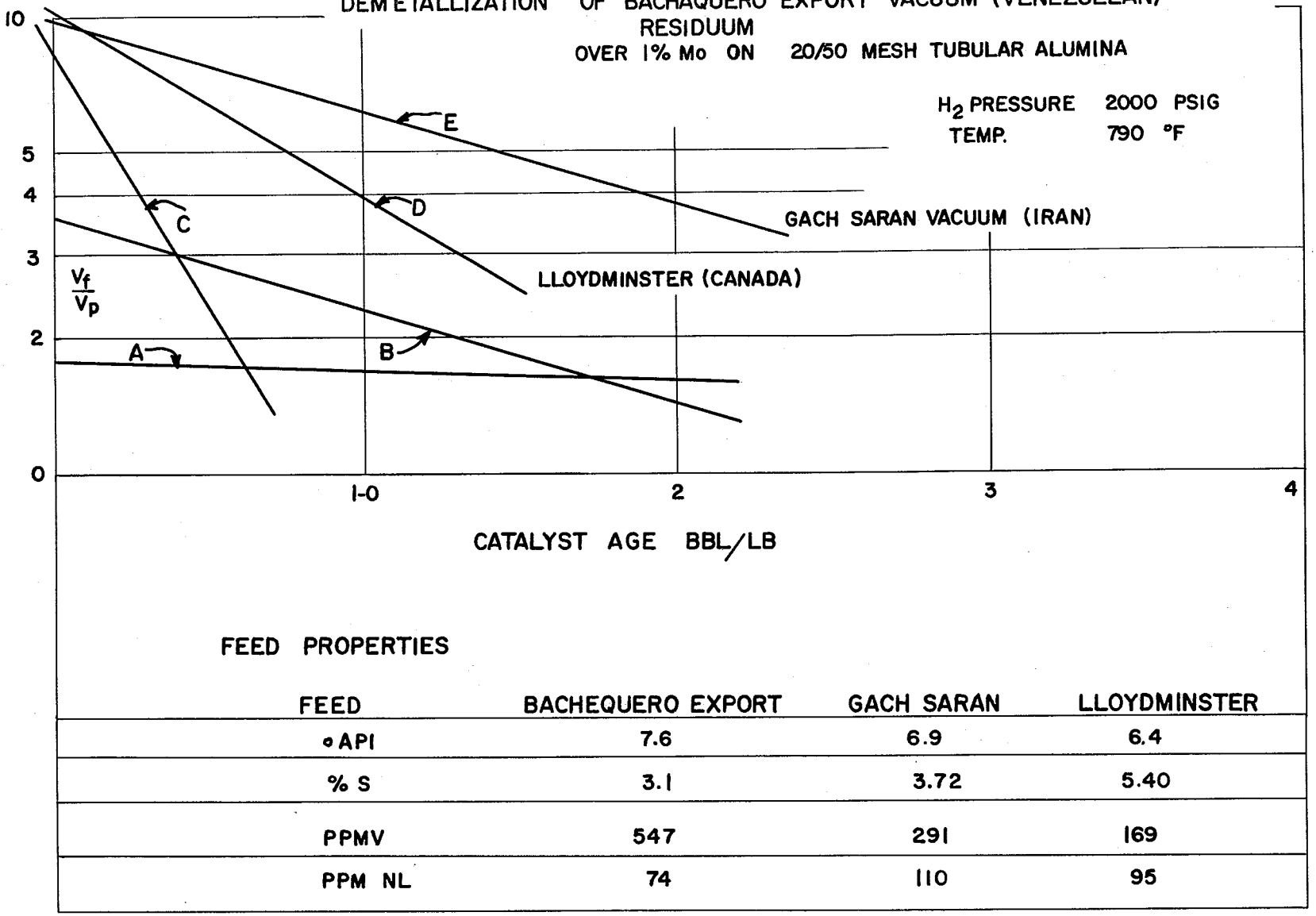
FIG. 2 shows the deactivation of demetallization catalysts as a function of the ratio of Vanadium in the feed to Vanadium in product plotted against catalyst age.

The invention is illustrated with reference to FIG. 2 which shows the deactivation phenomena in five demetallization runs, all of which were run at hydrogen partial pressure of 2000 psig and temperature of 790° F. Space velocity was varied to change the demetallization level. The feedstock properties are identified in Table I below:

Table 1

| Feed | Bachaquero Export | Gach Saran | Lloydminster |
|---|---|---|---|
| °API | 7.6 | 6.9 | 6.4 |
| Sulfur Wt. % | 3.1 | 3.72 | 5.40 |
| Va (ppm) | 547 | 291 | 169 |
| Ni (ppm) | 74 | 110 | 95 |

Curve A represents the demetallization of Bachaquero Export Vacuum residuum at a low initial level of Vanadium removal (45%). The low level of initial Vanadium removal was accomplished by conducting the demetallization reaction at a liquid space velocity of 1.5 $V_f/hr/V_r$, or catalyst space velocity corresponding to 0.114 barrels per day per pound or catalyst charged to the reactor. As in readily apparent from the slope of the curve, a deactivation is quite low, on the order of 0.11, due to the low level of demetallization accomplished under these conditions.

Curve B represents a demetallization run of a Bachaquero Export feedstock at an initial level of demetallization of 70%. This level of demetallization is accomplished by utilizing a liquid space velocity of 0.5 $V_f/hr/V_r$, or a catalyst space velocity of 0.037 barrels/day/pound of catalyst. The deactivation slope for this run is 0.44.

Curve C shows the results of a demetallization run of Bachaquero Export Vacuum residuum at an initial level of demetallization of 85%. This level of demetallization was accomplished by conducting the reaction at a liquid space velocity of 0.3 $V_f/hr/V_r$, or a catalyst space velocity of 0.023 barrels/day/lb. of catalyst. At a 85% level of demetallization, the deactivation slope is 2.65.

Curve D illustrates a high level of Vanadium removal from a Lloydminster vacuum residuum (85%) which was run at a liquid hourly space velocity of 0.65 $V_f/hr/V_r$, or a catalyst space velocity of 0.05 barrels/day/lb. of catalyst. The deactivation slope for this run was 0.95 as compared to 2.65 for the Bachaquero Export Vacuum residuum feedstock at the same initial demetallization.

Curve E represents a high level of Vanadium removal (90%) from a Gach Saran Vacuum residuum. A 90% initial level of demetallization was accomplished by running the reaction at a liquid space velocity of 0.75 $V_f/hr/V_r$, or a catalyst space velocity of 0.057 barrels/day/lb. of catalyst. The resulting catalyst deactivation slope was 0.49 as compared to 0.95 for Lloydminster feed and 2.65 for the Bachaquero vacuum residuum at similar high demetallization conditions.

As is readily apparent from the curves representing D and E, the catalyst deactivation slope is not dependent upon the amount of metal in the feedstock, as the demetallization of the lower metals containing Lloydminister feed resulted in a much high deactivation slope than from the corresponding operation of the high metal containing Gach Saran feedstock.

Figure 3:
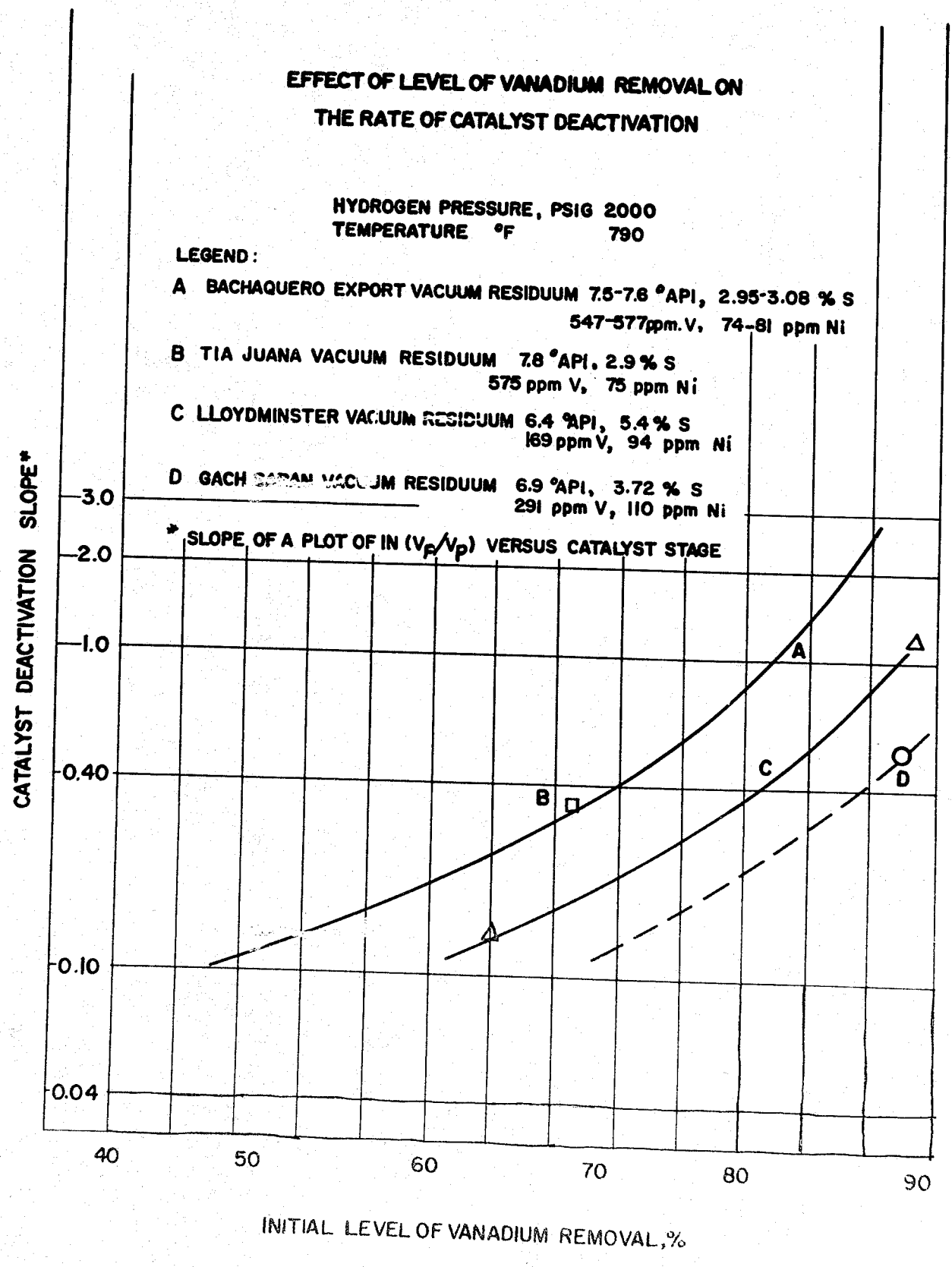
FIG. 3 shows the effect of level of Vanadium removal on the rate of catalyst deactivation

A summary of the foregoing runs is found by having reference to FIG. 3 which shows the effects of the initial level of Vanadium removal on the rate of catalyst deactivation. In addition to the aforestated runs, an additional run of a Venezuelan feedstock, a Tijuana vacuum residuum is presented which has the following characteristics; 7.8° A,B,I; 2.9% Sulfur, 575 ppm Vanadium and 75 ppm nickel. As can be seen from the graph, the catalyst deactivation slope is most pronounced in the case of Venezuelan residuum feedstocks.

The benefits to be derived from the invention heretofore described are further illustrated by reference to Table 2 set forth below:

TABLE 2

| FEED | BACHAQUERO EXPORT VACUUM BOTTOMS | |
|---|---|---|
| Catalyst | 1% Mo on 20/50 mesh Bauxite | |
| Case | 1 | 2 |
| Operating Conditions | | |
| Hydrogen Pressure, psig | 2000 | 2000 |
| Temperature, °F. | 790 | 790 |
| Catalyst Space Velocity, B/D/# | 0.023 | 0.03 |
| Initial Vanadium Removal | 87 | 72 |
| Catalyst Replacement Rate. #/B | % Vanadium Removal. | |
| 0.5 | 61 | 67 |
| 0.6 | 64 | 70 |
| 0.7 | 67 | 72 |

Runs 1 and 2 were carried out by initially feeding a Venezuelan feedstock, more specifically Bachaquero vacuum residuum to an ebullated bed type reactor as illustrated in FIG. 1. The conditions of runs 1 and 2 were chosen so that the initial or start-up demetallization level was 87% and 72% respectively. After the level of demetallization had dropped at least 10%, the catalyst replacement rate was adjusted as indicated in Table 2 to provide equilibrium demetallization levels set forth therein.

As can be seen from the table, where the initial level of demetallization is maintained at a high rate, as for an example, run 1 (87% removal) the catalyst deactivation is significant. For example, in order to obtain an equilibrium demetallization level of 67%, a catalyst replacement rate of 0.5 lb. catalyst/barrel of feedstock is required when the initial level of demetallization is kept below 75%. Where the initial level of demetallization is greater than 75%, more specifically, 87% as illustrated by run 1, a catalyst replacement of 0.7 lbs. of catalyst/barrel of feedstock is required, or a 40% increased in catalyst consumption is required. Such an increase in catalyst replacement rates significantly adds to the cost of the demetallization operation. Surprisingly, applicants have found therefore, that by maintaining the initial demetallization rate less than 75% that dramatic cost savings are achieved by utilization of far less catalyst than would otherwise be required at high level operations.

Although the above example and discussions disclose a preferred mode of embodiment of this invention, it is recognized that from such disclosures, many modifications will now be made obvious to those skilled in the art and it is understood, therefore, that this invention is not limited to only those specific methods, steps or combination or sequence of method steps described, but covers all equivalent steps or methods that may fall within the scope of the appended claims.

I claim:

1. A process for the catalytic demetallization of Venezuelan crude oil feedstocks containing organometallic impurities comprising Vanadium and nickel, in a reaction zone wherein demetallization catalyst, hydrogen and crude oil feedstock are brought into intimate contact under operating conditions of temperature, between 700° and 850° F., pressure between, 56 and 245 atmospheres, (800 to 3500 psig) and liquid space velocities between 0.2 to 1.5 $V_f/hr/V_r$ comprising the steps of:

(a) initially feeding the feedstock to the reaction zone containing a fresh initial charge of the demetallization catalyst, under operating conditions of temperature, pressure and space velocity selected within said ranges, such that the initial level of Vanadium removal does not exceed 75 wt. percent;

(b) maintaining said operating conditions for a period sufficiently long, such that the level of Vanadium removal decreases by about 10% of the initial level;

(c) adjusting said operating conditions to achieve a desired level of metals removal, said level being less than 75 wt. percent;

(d) removing a demetallized stream from the reaction zone.

2. The process of claim 1, wherein the reaction zone contains a fixed bed of catalyst.

3. The process of claim 1, wherein the reaction zone contains an ebullated bed of catalyst.

4. The process of claim 1, wherein the crude oil feedstock is selected from the group consisting of Bachaquero residuum, Tia Juana residuum, Lagunillas residuum, Boscan residuum, and Orinoco residuum.

5. The process of claim 1, wherein the demetallization catalyst is bauxite promoted with Molybdenum.

6. The process of claim 1, wherein the initial level of demetallization is between 45 and 75 wt. percent.

7. The process of claim 1 wherein the reaction zone temperature is maintained between 750° F. and 840° F., hydrogen partial pressure between 1,000 and 2,500 psig, and space velocity between 0.3 and 1.3 $V_f/hr/V_r$.

8. A process for the catalytic demetallization of Venezuelan crude oil feedstocks containing organometallic impurities comprising of Vanadium and nickel, in an ebullated bed reaction zone in the presence of demetallization catalyst under operating conditions of temperature between 750° and 850° F., pressures between 56 and 245 atm. (800 to 3500 psig) and catalyst space velocities between 0.01 and 0.4 Bbl/D/lb catalyst, comprising the steps of:

(a) initially feeding the feedstock to the reaction zone containing fresh initial charge of demetallization catalyst, under operating conditions of temperature, pressure and space velocity selected within said ranges, such that the initial level of Vanadium removal does not exceed 75 wt. percent;

(b) maintaining said operating conditions for a period sufficiently long such that the level of Vanadium removal decreases by about 10 percent of the initial level;

(c) adjusting operating conditions to achieve the desired level of metals removal less than 75 wt. percent; and (d) establishing a catalyst replacement rate between 0.15 and 3.0 pounds of catalyst per barrel of feed, such that the demetallization rate is maintained constant below 75%; thereby reducing the rate of catalyst deactivation and extending the life of the catalyst.

9. Process of claim 8, wherein the initial level of demetallization is between 45 and 75 weight percent.

10. The process of claim 8 wherein the reaction zone temperature is maintained between 750° F. and 840° F., hydrogen partial pressure between 1,000 and 2,500 psig, catalyst space velocity between 0.03 and 0.114 bbl/day/lb catalyst, and catalyst replacement rate between 0.2 and 1.8 lb/bbl of feed.

* * * * *